US011504574B2

(12) United States Patent
Tsai

(10) Patent No.: US 11,504,574 B2
(45) Date of Patent: Nov. 22, 2022

(54) PEDAL EXERCISER

(71) Applicant: Care & Care Health Products Co., Ltd., Miao Li County (TW)

(72) Inventor: Max Tsai, Miao Li County (TW)

(73) Assignee: CARE & CARE HEALTH PRODUCTS CO., LTD., Miao Li County (TW)

( * ) Notice: Subject to any disclaimer, the term of this patent is extended or adjusted under 35 U.S.C. 154(b) by 67 days.

(21) Appl. No.: 17/038,932

(22) Filed: Sep. 30, 2020

(65) Prior Publication Data

US 2022/0096895 A1 Mar. 31, 2022

(51) Int. Cl.

| | |
|---|---|
| ***A63B 22/06*** | (2006.01) |
| ***A63B 23/04*** | (2006.01) |
| ***A63B 21/00*** | (2006.01) |

(52) U.S. Cl.

CPC .... *A63B 22/0605* (2013.01); *A63B 21/00069* (2013.01); *A63B 21/00192* (2013.01); *A63B 21/15* (2013.01); *A63B 21/4034* (2015.10); *A63B 22/0694* (2013.01); *A63B 23/0476* (2013.01); *A63B 2209/08* (2013.01)

(58) Field of Classification Search

CPC .. A63B 22/0605–2022/0658; A63B 21/00069; A63B 21/00192; A63B 21/005–0052; A63B 21/15

See application file for complete search history.

(56) References Cited

U.S. PATENT DOCUMENTS

| | | | | |
|---|---|---|---|---|
| 5,094,447 A * | 3/1992 | Wang | A63B 22/0605 482/903 |
| 2004/0009848 A1* | 1/2004 | Lee | A63B 22/0694 482/57 |
| 2018/0036586 A1* | 2/2018 | Cristofori | A63B 22/0087 |

FOREIGN PATENT DOCUMENTS

TW 563562 U 11/2003

OTHER PUBLICATIONS

Machine Translation of TW563562, Google Translate (Year: 2003).*
Search Report appended to an Office Action, which was issued to Taiwanese counterpart application No. 109113777 by the TIPO dated Sep. 15, 2020, with an English translation thereof.

* cited by examiner

*Primary Examiner* — Jennifer Robertson

(57) ABSTRACT

A pedal exerciser includes a worm shaft meshed with a worm wheel. A crank drives rotation of the worm wheel through two pedals. A rotary disc assembly is journaled to and rotatable with the worm shaft. The rotary disc assembly has a conductive member that is non-magnetizable and that is rotatable around an axis of the worm shaft. A magnetic assembly is disposed near the conductive member and has a magnet facing the conductive member. The magnet produces a drag force to resist an exercising force when the conductive member is rotated to move past the magnet. An adjustment assembly moves the magnetic assembly toward or away from the rotary disc assembly to vary the magnitude of the drag force.

10 Claims, 7 Drawing Sheets

PEDAL EXERCISER

FIELD

The disclosure relates to an exerciser, and more particularly to a pedal exerciser.

BACKGROUND

FIG. 1 illustrates an existing pedal exerciser 1, disclosed in Taiwanese Patent No. M419585. The pedal exerciser 1 includes a stand assembly 11, a cylindrical housing 12, a crank 13, two pedals 14 and a resistance adjuster 15. The cylindrical housing 12 is disposed above the stand assembly 11. The crank 13 rotatably extends through the cylindrical housing 12. The pedals 14 are respectively connected to two opposite ends of the crank 13. The resistance adjuster 15 rotatably extends through the cylindrical housing 12 and frictionally contacts the crank 13. A frictional force between the resistance adjuster 15 and the crank 13 is adjustable by rotating the resistance adjuster 15, and is used as a rotation-resisting force to resist an exercising force applied by the user to the pedals 14.

However, when the speed of pedaling the pedal exerciser 1 is high, the rotation-resisting force of the resistance adjuster 15 becomes dynamic friction force, which can cause the user to feel that he/she is pedaling effortlessly. The exercise effect of the pedal exerciser 1 is therefore poor.

SUMMARY

Therefore, an object of the disclosure is to provide a pedal exerciser that can alleviate the aforesaid drawback of the prior art.

According to the disclosure, a pedal exerciser includes a support unit, a rotary unit, a pedal unit, and a magnetic resistance unit.

The rotary unit is disposed on the support unit, and includes a worm wheel, and a worm shaft meshed with the worm wheel.

The pedal unit includes a crank and two pedals. The crank extends through the worm wheel to drive rotation of the worm wheel. The pedals are respectively connected two opposite ends of the crank. The magnetic resistance unit provides a rotation-resisting force to resist an exercising force applied to the pedals.

The magnetic resistance unit includes a rotary disc assembly, a magnetic assembly, and an adjustment assembly.

The rotary disc assembly is journaled to the worm shaft distally to the worm wheel and rotatable with the worm shaft. The rotary disc assembly has a conductive member that is non-magnetizable and that is rotatable around an axis of the worm shaft.

The magnetic assembly is disposed near the conductive member in a spaced apart manner and has at least one magnet facing the conductive member. The at least one magnet is capable of producing a drag force as the rotation-resisting force when the conductive member is rotated to move past the at least one magnet.

The adjustment assembly is used to move the magnetic assembly toward or away from the rotary disc assembly for varying the magnitude of the drag force.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
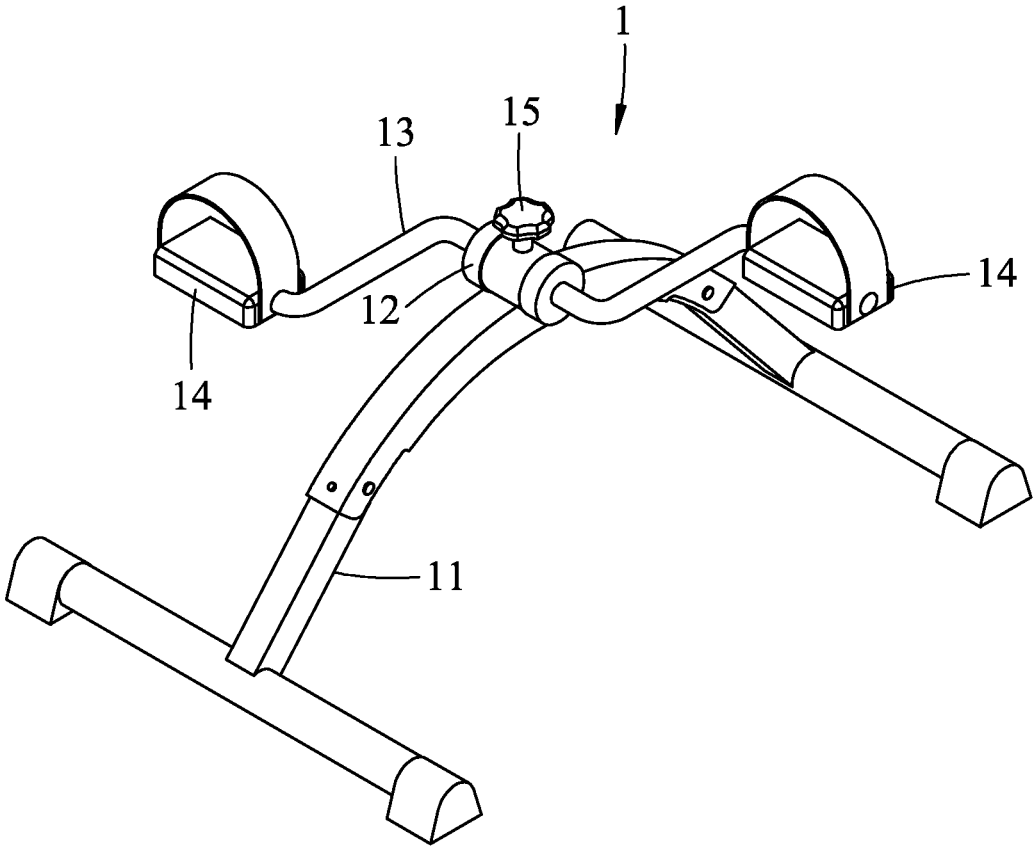
FIG.1 PRIOR ART
FIG. 1 is a perspective view of an existing pedal exerciser.
Figure 2:
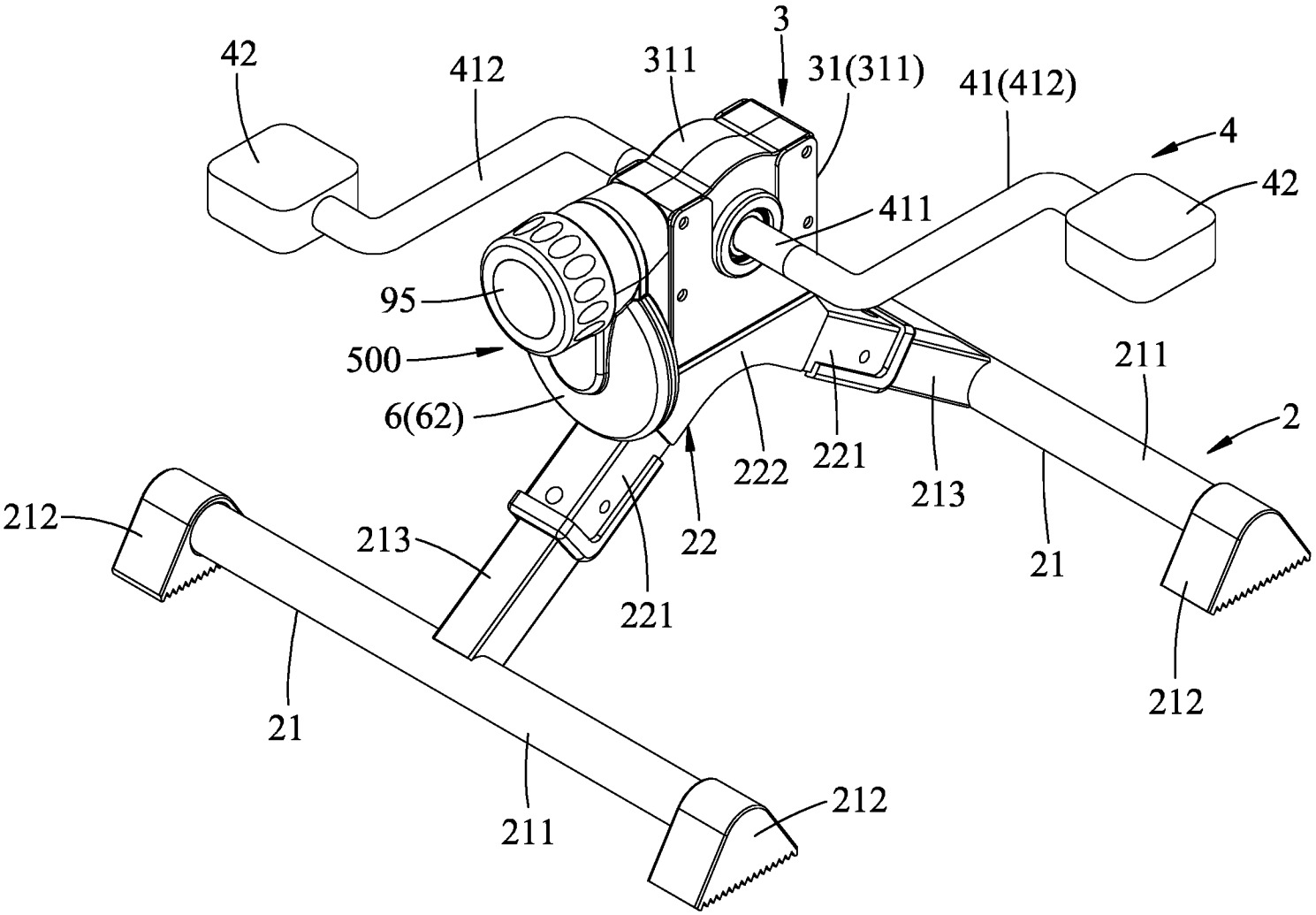
FIG. 2 is a perspective view of a pedal exerciser according to an embodiment of the disclosure.
Figure 3:
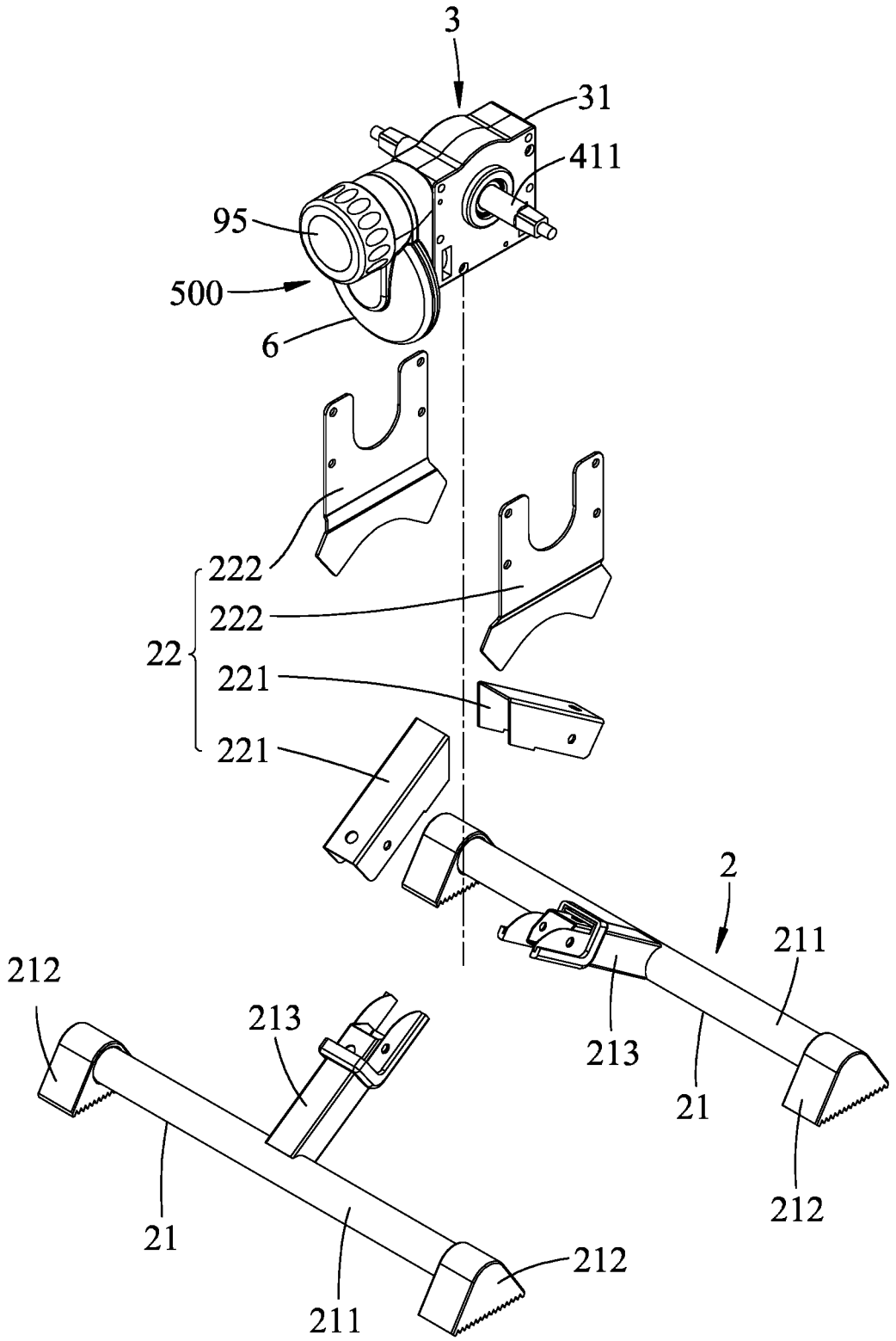
FIG. 3 is a partly exploded perspective view of the embodiment.
Figure 4:
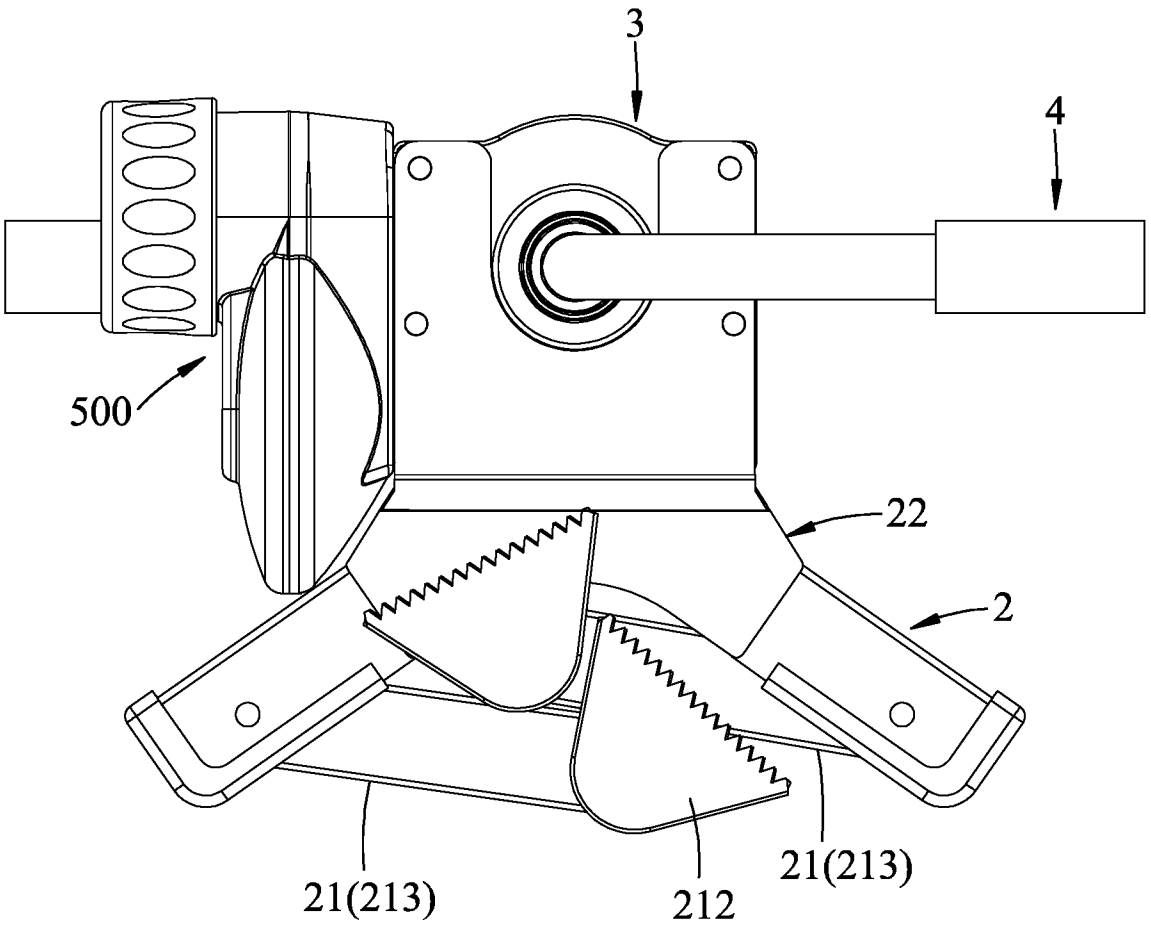
FIG. 4 is a side view of the embodiment in a storage state.

FIGS. 2 to 4 illustrate a pedal exerciser according to an embodiment of the disclosure. The pedal exerciser includes a support unit 2, a rotary unit 3, a pedal unit 4, and a magnetic resistance unit 500.

The support unit 2 includes two spaced-apart stands 21, and a connection assembly 22 connecting the stands 21. Each stand 21 has a bottom tube 211, two anti-slip blocks 212 respectively disposed on two opposite ends of the bottom tube 211, and a support tube 213 extending upwardly from the bottom tube 211. The support tubes 213 of the stands 21 are inclined to each other. A bottom side of the connection assembly 22 is open and is mounted on the support tubes 213 in a straddling manner. In particular, the connection assembly 22 includes two brackets 221 respectively and pivotally connecting the support tubes 213, and two coupling plates 222 spaced apart from each other. Each bracket 221 has an inverted U-shape with an open bottom. Each coupling plate 222 has two opposite sides respectively connected to the coupling brackets 221. The stands 21 are foldable relative to the connection assembly 22 for stacking the support tubes 213 to save space in storage.

Figure 5:
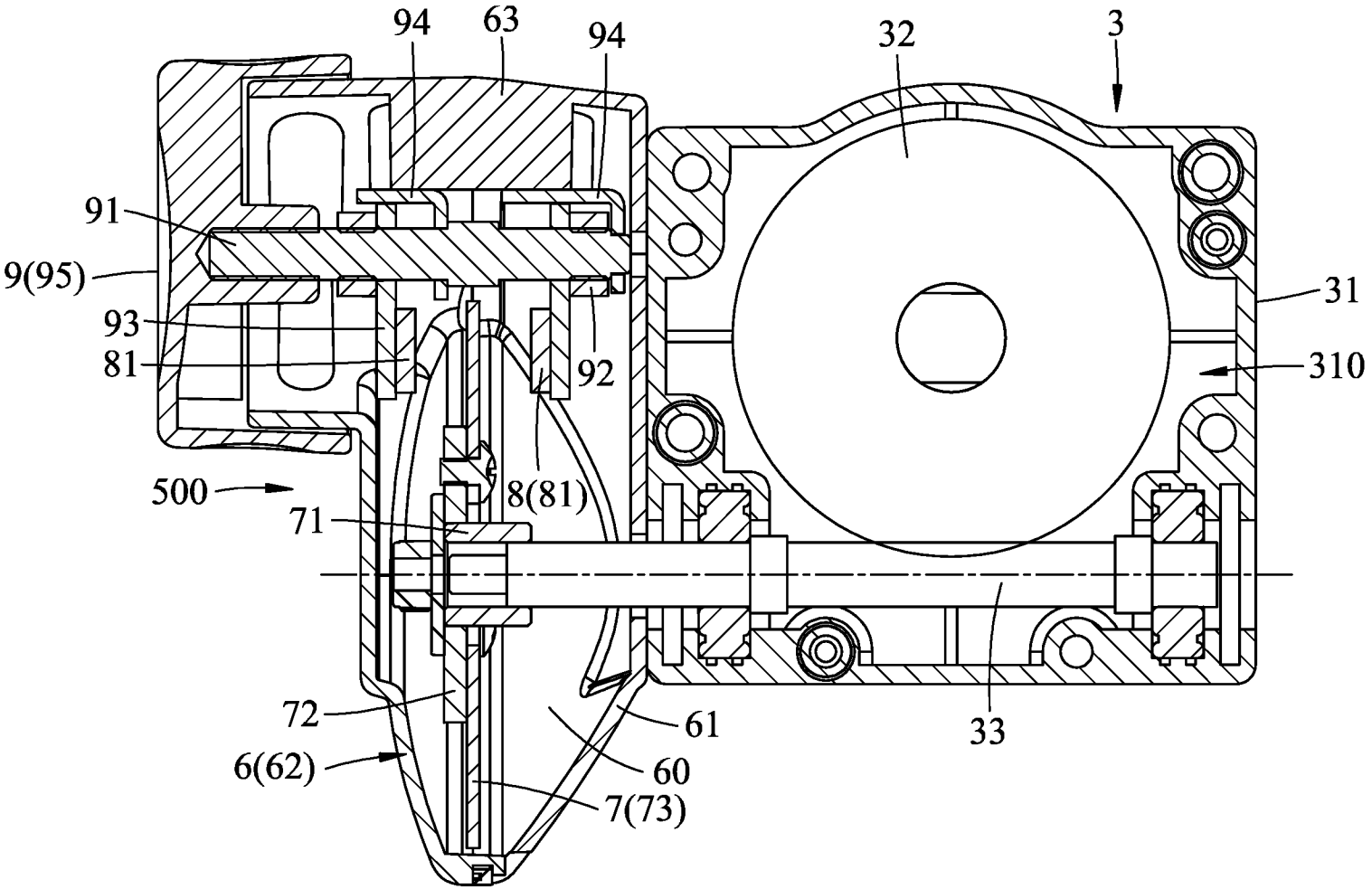
FIG. 5 is a sectional view of the embodiment illustrating a rotary unit, a rotary disc assembly, a magnetic assembly and an adjustment assembly of the pedal exerciser.
Figure 6:
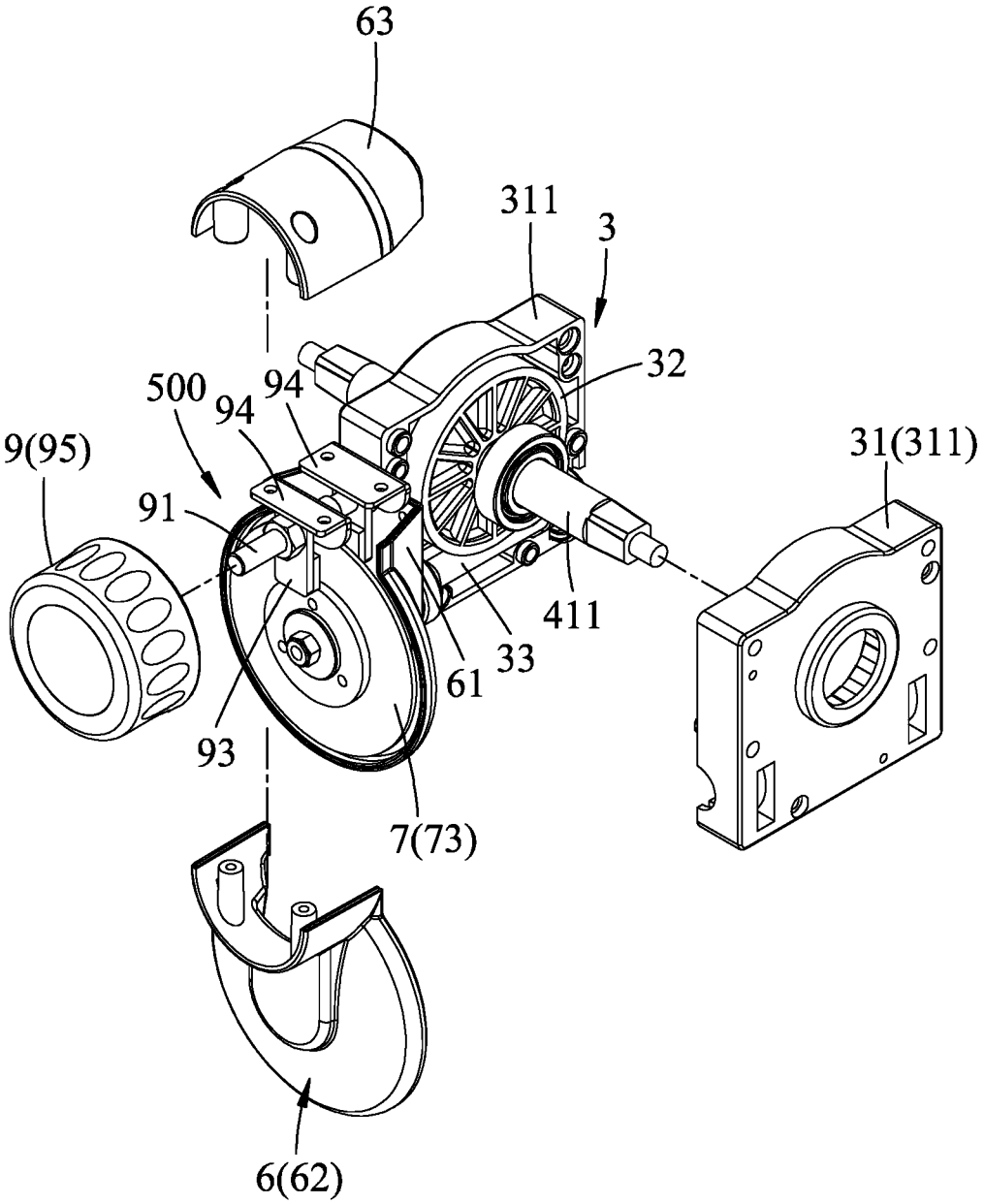
FIG. 6 is an exploded perspective of the embodiment illustrating the rotary unit, the rotary disc assembly, the magnetic assembly and the adjustment assembly.

Referring to FIGS. 2, 5 and 6, the rotary unit 3 is disposed on the connection assembly 22 of the support unit 2 upwardly from the stands 21. The rotary unit 3 includes a casing 31, a worm wheel 32, and a worm shaft 33. The casing 31 has two casing halves 311 coupled to each other and cooperatively defining an accommodating space 310. The worm wheel 32 is rotatably received in the accommodating space 310. The worm shaft 33 extends beneath the worm wheel 32. The worm shaft 33 is meshed with and driven by the worm wheel 32 to rotate. In this embodiment, the transmission ratio of the worm wheel 32 to the worm shaft 33 is 1:26.

The pedal unit 4 includes a crank 41, and two pedals 42. The crank 41 extends through the worm wheel 32 to drive rotation of the worm wheel 32. The crank 41 has an axle portion 411 extending through the worm wheel 32, and two arm portions 412 respectively connected to two opposite ends of the axle portion 411. The pedals 42 are respectively connected to the arm portions 412. The crank 41 is driven by pedals 42 to rotate the worm wheel 32 for rotation of the worm shaft 33.

The magnetic resistance unit 500 is used to provide a rotation-resisting force to resist an exercising force applied to the pedals 42. The magnetic resistance unit 500 includes a cover assembly 6, a rotary disc assembly 7, a magnetic assembly 8, and an adjustment assembly 9. The cover assembly 6 is proximate to the casing 31 and has an installation space 60. The cover assembly 6 includes a rear cover part 61 abutting the casing 31, a front cover part 62 coupled to the back cover part 61, and a top cover part 63 covering tops of the rear and front cover parts 61, 62. The installation space 60 is bounded by the rear, front and top cover parts 61, 62, 63. The worm shaft 33 extends from the accommodating space 310 into the installation space 60.

Figure 7:
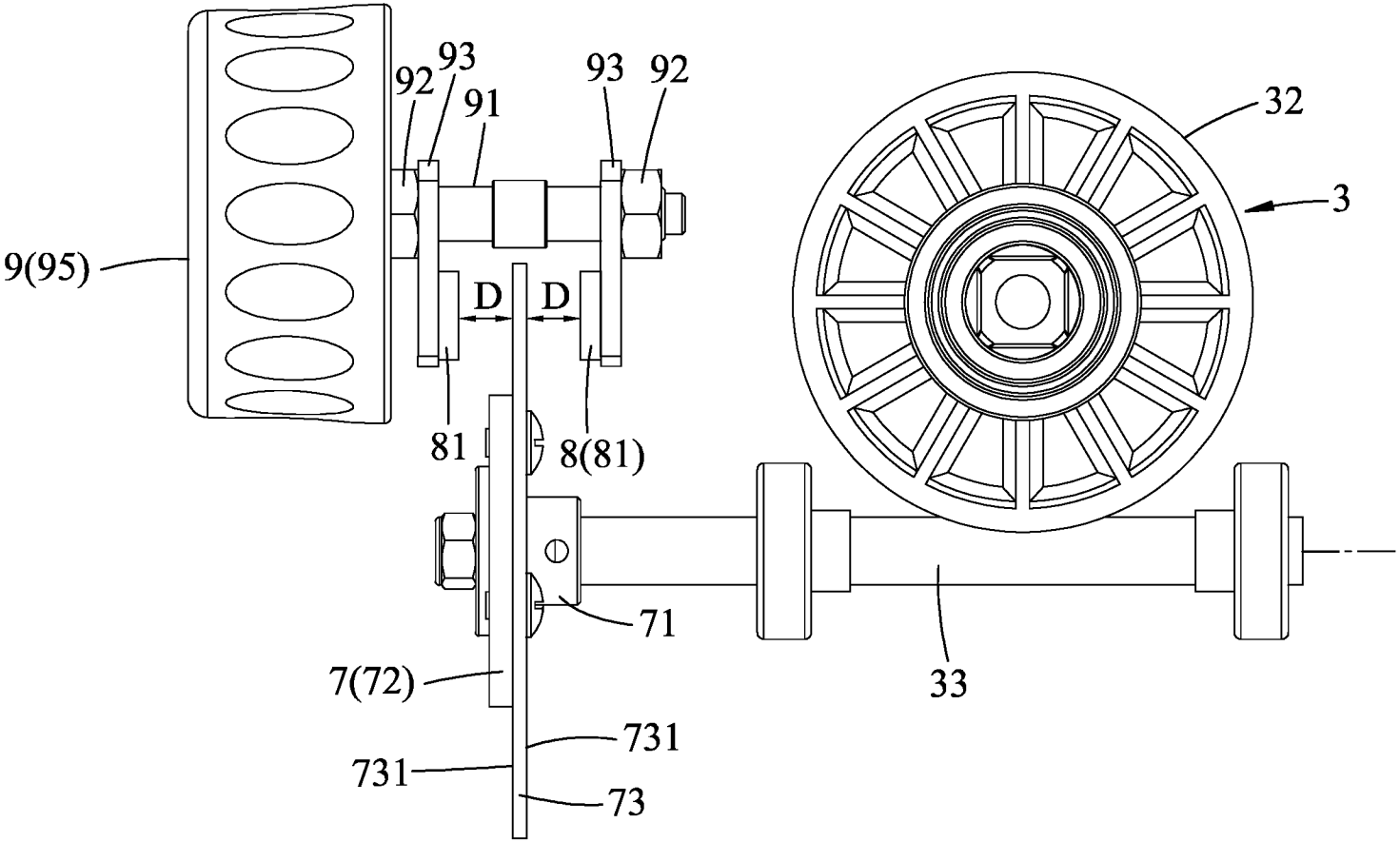
FIG. 7 is a side view of the embodiment with a casing and a cover assembly being omitted.

As shown in FIGS. 5 to 7, the rotary disc assembly 7 is received in the installation space 60 and is journaled to the worm shaft 33 distally of the worm wheel 32 to rotate along with the worm shaft 33. The rotary disc assembly 7 includes a wheel seat 71, a wheel 72, and a conductive member 73. The wheel seat 71 is fixedly journaled to the worm shaft 33. The wheel 72 is disposed around the wheel seat 71. The conductive member 73 is fixed to the wheel 72. The conductive member 73 is non-magnetizable, made of metal such as aluminum or copper, and is rotatable around an axis of the worm shaft 33. In this embodiment, the conductive member 73 is a conductive disc made of aluminum. In addition, the conductive member 73 has two conductive surfaces 731 that are opposite to each other in a direction parallel to the axis of the worm shaft 33 and that extend radially and angularly. In other embodiments, the wheel seat 71 and the wheel 72 may be omitted while the conductive member 73 is directly journaled to the worm shaft 33 such that the rotary disc assembly 7 is rotatable with the worm shaft 33.

The magnetic assembly 8 is received in the accommodating space 60 above the worm shaft 33 and is disposed near the conductive member 73 in a spaced apart manner. The magnetic assembly 8 has two magnets 81 respectively facing the two opposite surfaces 731 of the conductive member 73. In this embodiment, each magnet 81 is a permanent magnet disposed at a distance (D) from the respective surface 731. The magnetic assembly 8 is capable of producing a drag force as the rotation-resisting force to resist the exercising force when the conductive member 73 is rotated to move past the magnets 81. In other embodiments, the number of said magnets 81 may be one or more than three and may be arranged along an angular direction with respect to the conductive member 73. When the number of the magnets 81 is increased, the rotation-resisting force produced by the magnetic assembly 8 is increased.

The adjustment assembly 9 includes a screw rod 91, two nuts 92, two mounting plate 93, two limiting plates 94, and a rotary adjuster 95. The screw rod 91 is disposed in the cover assembly 6 and extends parallel to the axis of said worm shaft 33. The nuts 92 are threadedly and movably disposed on the screw rod 91 and are opposite to each other on the screw rod 91. The mounting plates 93 are respectively connected to and driven by the nuts 92. The limiting plates 94 are fixed to the cover assembly 6 and disposed around the screw rod 91. The rotary adjuster 95 is exposed from the cover assembly 6 and is fixedly connected to the screw rod 91 to drive rotation of the screw rod 91. In this embodiment, the screw rod 91 is a right and left hand threaded rod. The nuts 92 are right and left hand nuts. The number of the magnets 81 corresponds to that of the mounting plates 93, and the magnets 81 are respectively disposed on the mounting plates 93. Each mounting plate 93 extends radially toward the worm shaft 33 from the respective nut 92 such that the respective magnet 81 is disposed between the screw rod 91 and the worm shaft 33. The mounting plates 93 are disposed on two opposite sides of the conductive member 73 in a spaced apart manner and respectively face the conductive surfaces 731. The conductive member 73 is rotatable between the screw rod 91 and the worm shaft 33. When the screw rod 91 is rotated, the nuts 92 on the screw rod 91 are moved toward or away from each other together with the mounting plates 93. The limiting plates 94 are fixed to the top cover part 63 to limit the mounting plates 93 from rotating when the screw rod 91 rotates.

When the screw rod 91 is rotated by rotating the rotary adjuster 95, the nuts 92 on the screw rod 91 are moved together with the mounting plates 93 toward or away from each other so as to adjust distances (D) of the magnets 81 from the conductive surfaces 731, thereby varying the magnitude of the drag force. For example, when the magnets 81 are moved to reduce the distances (D) of the magnets 81 from the conductive surfaces 731, the drag force is increased. In this embodiment, the rotary adjuster 95 is a knob that is hand operable without using electricity. In other embodiments, the rotary adjuster 95 may be a lever or other equivalent elements.

Noteworthy, the adjustment assembly 9, the magnetic assembly 8 and the worm wheel 32 are situated above the worm shaft 33. As such, the rotary adjuster 95 can be disposed near a user to facilitate manipulation of the rotary adjuster 95. In addition, the rotary adjuster 95 may be prevented from interfering with the pedals 42.

For using the pedal exerciser, the user may sit in a chair (not shown) and the pedal exerciser may be placed on a floor in front of the chair. During pedaling, the drag force is produced by relative movements of the conductive member 73 and the magnets 81. When the rotation speed of the conductive member 73 is increased by increasing the speed of the pedals 42, the drag force is increased. Unlike the fictional force of the conventional exerciser, which decreases as the pedaling speed increases, the drag force or rotation-resisting force increases as the pedaling speed increases. To increase the pedaling speed, the user need to apply much effort to pedal quickly. Therefore, the exercise effect of the pedal exerciser 1 is very efficient. Further, because no friction force is used to resist rotation, no heat generation problem will occur. In addition, by virtue of the casing 31 and the cover assembly 6, dust and debris are prevented from entering the accommodating space 310 and the installation space 60 to ensure operational smoothness, and the components inside the casing 31 and the cover assembly 6 are prevented from hurting the user's hands and feet.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A pedal exerciser, comprising:
a support unit;
a rotary unit disposed on said support unit, and including
a worm wheel, and
a worm shaft meshed with said worm wheel;
a pedal unit including
a crank extending through said worm wheel to drive rotation of said worm wheel, and
two pedals respectively connected to two opposite ends of said crank; and
a magnetic resistance unit for providing a resistance to an exercising force applied to said pedals, said magnetic resistance unit including
a rotary disc assembly journaled to said worm shaft distally of said worm wheel and rotatable with said worm shaft, said rotary disc assembly having a conductive member that is non-magnetizable and that is rotatable around an axis of said worm shaft,
a magnetic assembly disposed near said conductive member in a spaced apart manner and having at least one magnet facing said conductive member, said at least one magnet being capable of producing a drag force, which serves as the resistance to the exercising force when said conductive member is rotated to move past said at least one magnet, and
an adjustment assembly for moving said magnetic assembly toward or away from said rotary disc assembly to vary the magnitude of the drag force;
wherein said adjustment assembly includes a screw rod parallel to the axis of said worm shaft, at least one nut threadedly disposed on said screw rod and movable along said screw rod when said screw rod is rotated, and at least one mounting plate connected to said at least one nut, said at least one magnet being disposed on said at least one mounting plate and facing said conductive member of said rotary disc assembly.

2. The pedal exerciser as claimed in claim 1, wherein said conductive member has two conductive surfaces that are opposite to each other in a direction parallel to the axis of said worm shaft and that extend radially and angularly, said at least one magnet having two magnets respectively facing two opposite surfaces of said conductive member.

3. The pedal exerciser as claimed in claim 2, wherein said conductive member is a conductive disc that has said conductive surfaces.

4. The pedal exerciser as claimed in claim 3, wherein said rotary disc assembly further includes a wheel seat fixedly journaled to said worm shaft, and a wheel disposed around said wheel seat, said conductive member being fixed to said wheel.

5. The pedal exerciser as claimed in claim 1, wherein said at least one mounting plate extends radially toward said worm shaft from said at least one nut such that said at least one magnet is disposed between said screw rod and said worm shaft, said conductive member being rotatable between said screw rod and said worm shaft.

6. The pedal exerciser as claimed in claim 1, wherein said at least one magnet has multiple magnets, the number of said magnets corresponding to that of said at least one mounting plate.

7. The pedal exerciser as claimed in claim 1, wherein said at least one magnet is a permanent magnet.

8. The pedal exerciser as claimed in claim 1, wherein:
said conductive member has two conductive surfaces opposite to each other in a direction parallel the axis of said worm shaft;
said at least one nut includes two nuts opposite to each other on said screw rod, said at least one mounting plate including two mounting plates respectively connected to and driven by said nuts, said mounting plates being disposed on two opposite sides of said conductive member in a spaced apart manner and respectively facing said conductive surfaces;
said at least one magnet includes two magnets respectively disposed on said mounting plates and respectively facing said conductive surfaces; and
said nuts are movable toward or away from each other so as to adjust distances of said magnets from said conductive surfaces.

9. The pedal exerciser as claimed in claim 1, wherein said adjustment assembly further includes a rotary adjuster connected to said screw rod to drive rotation of said screw rod.

10. The pedal exerciser as claimed in claim 1, wherein said rotary unit further includes a casing having an accommodating space that receives said worm wheel; said magnetic resistance unit further includes a cover assembly that is proximate to said casing and that has an installation space receiving said rotary disc assembly and said magnetic assembly; and said worm shaft extends from said accommodating space into said installation space.

* * * * *